United States Patent [19]

Horwinski et al.

[11] 4,250,967

[45] Feb. 17, 1981

[54] SAFETY TRASH CONTAINER HAVING A MOVABLE CLOSURE AND AN EXTINGUISHANT

[75] Inventors: Elwood R. Horwinski, Cheshire, Conn.; Joseph M. Geremia, 6313 W. Elton Ave., Las Vegas, Nev. 89107; John Jarmie, East Haven, Conn.

[73] Assignee: Joseph M. Geremia, Las Vegas, Nev.

[21] Appl. No.: 72,886

[22] Filed: Sep. 6, 1979

[51] Int. Cl.[3] ..... A62C 37/18

[52] U.S. Cl. ..... 169/49; 169/61; 169/11; 169/30

[58] Field of Search ..... 169/11, 30, 33, 48, 169/49, 50, 54, 60, 61, 62, 66, 68, 71, 90, 91; 131/235, 236

[56] References Cited

U.S. PATENT DOCUMENTS

| | | | |
|---|---|---|---|
| 3,182,727 | 5/1965 | Minton | 169/49 |
| 3,489,223 | 1/1978 | Bundo, Sr. | 169/56 X |
| 3,695,277 | 10/1972 | Moffa | 131/235 R |
| 3,802,510 | 4/1974 | Johnson | 169/37 |
| 3,865,192 | 2/1975 | Dunphy | 169/61 |
| 4,194,572 | 3/1980 | Thery et al. | 169/66 |

*Primary Examiner*—Robert J. Spar
*Assistant Examiner*—Fred A. Silverberg
*Attorney, Agent, or Firm*—H. Gibner Lehmann; K. Gibner Lehmann

[57] ABSTRACT

A safety trash container for disposal of cigars, cigarettes, papers and the like, comprising in combination a receptacle having an opening at one end and a closure member adapted to fit the opening. Structure is provided within the receptacle for mounting the closure member for movement between an open position wherein the opening of the receptacle is exposed and accessible for deposit of trash, and a closed position wherein the opening is substantially sealed off. A heat responsive mechanism is also provided within the receptacle, for sensing a rise in its internal temperature due to inadvertent ignition of the contents thereof, and a powered operator device is associated with the mounting structure for the closure member and connected with the latter for advancing it to its closed position in response to operation of the heat-responsive mechanism, thereby sealing off the receptacle opening and confining and smothering any flames resulting from a fire occurring therein.

22 Claims, 6 Drawing Figures

36
38
32
40
38
42

34
44
100
56
48
54
50
56
52
108
72
64
66
106
104
74
58
60
70
68
62

SAFETY TRASH CONTAINER HAVING A MOVABLE CLOSURE AND AN EXTINGUISHANT

BACKGROUND

This invention relates generally to trash containers, and more particularly to containers of the type especially adapted to accept cigar and cigarette butts, and small wrappers and papers associated therewith.

In the past, conventional cigarette disposal receptacles have employed generally cylindrical metal stands carrying relatively broad, shallow trays which were partially filled with sand. With such devices, ignited cigars and cigarettes could be readily extinguished and disposed of by merely projecting the lighted end part way into the sand, such that the latter smothered the glowing ashes.

While these units have found wide acceptance, a number of disadvantages were apparent. Although these devices were aesthetically acceptable immediately following initial installation and prior to use, they tended to become rather unsightly after a period of time. The presence of previously deposited items in the shallow trays sometimes discouraged their further use, especially if they were filled to capacity, or contained excessive amounts of wrappers and/or paper material. Morever there existed a distinct fire hazard in the event that such papers became ignited due to either smoldering ashes or an improperly disposed-of cigarette. Also, the task or properly emptying such trays was awkward, in that following use, there existed a mixture of sand and paper and/or tobacco products. The sand tended to spill easily; accordingly such arrangements were not particularly well suited to use in hotels or other public places where it was considered especially desirable to maintain a neat, well-kept appearance.

Still other types of trash containers involved larger metal receptacles having hinged, spring-biased doors, with the word "PUSH" applied thereto or stamped therein. These units were better suited to use, for the disposal of larger paper items. However, un-extinguished cigars and cigarettes which were inadvertently deposited in such receptacles frequently caused ignition of the paper contents thereof. Fires which occured in such units tended to go un-noticed at first. When they did become apparent to the personnel responsible for the units, the fires had sometimes progressed a considerable extent, making them more difficult to extinguish as well as causing both heat damage to the container, and smoke or soot damage to the surrounding area.

SUMMARY

The above drawbacks and disadvantages of prior trash disposal units are obviated by the present invention which has for an object the provision of a novel and improved automatically extinguishing safety trash container which is simple in construction, reliable in operation and which has few separate parts, which can be readily fabricated from existing materials.

Yet another object is the provision of a safety trash container which operates to automatically reset itself after it has confined and smothered the contents in the event that the latter inadvertently become ignited.

Still another object of the invention is the provision of an improved trash container as above, which can hold a relatively large quantity of material, thus minimizing the necessity for emptying the unit every day.

Yet another object of the invention is the provision of an improved container as above characterized, which has a relatively small opening for deposit of trash, thereby discouraging the deposit of large paper or cardboard items, such as paper cups, cardboard boxes, and the like.

A still further object of the invention is the provision of an improved container in accordance with the foregoing, which is both aesthetically appealing and functionally effective, and capable of providing extended service over prolonged periods of operation. All items which are deposited will land in an area within the receptacle which is completely concealed from view, thereby making the unit more pleasing in appearance, and less objectionable from the standpoint of neatness or cleanliness.

The above objects are accomplished by the provision of a safety container for disposal of cigarettes, small papers and the like, comprising a receptacle having an opening at one end, and a movable closure member adapted to fit the opening. The closure member is shiftable between a closed position wherein it spans the opening of the receptacle and substantially seals off the same, and an open position wherein the opening is accessible for the deposit of cigarettes and papers. There are provided a heat responsive means disposed within the receptacle for sensing a rise in its internal temperature, and powered means rendered operable by the heat responsive means, for shifting the closure member to its closed position. The arrangement is such that in the event of inadvertent ignition of the contents of the receptacle, the heat responsive means actuates the powered means, which in turn advances the closure member such that it quickly seals off the receptacle opening and substantially completely confines and smothers any resulting flames. Also, extinguishing fluid is sprayed on the burning contents. Thus the extent of the fire is readily controlled, and the possibility of damage resulting therefrom is virtually eliminated.

In the drawings, illustrating a preferred embodiment of the invention:

Figure 1:
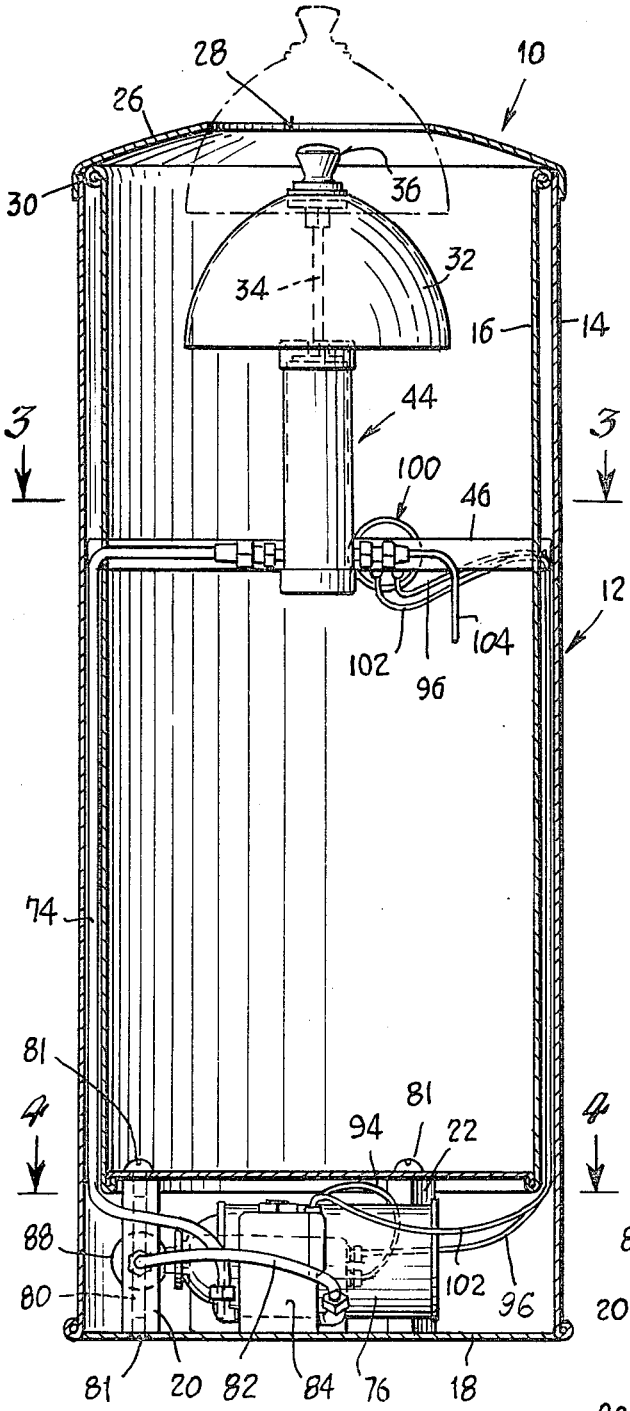
FIG. 1 is a vertical section of the improved safety trash container of the present invention, showing the closure member disposed in the open position, and showing in dotted outline, the position it would occupy when closed.
Figure 2:
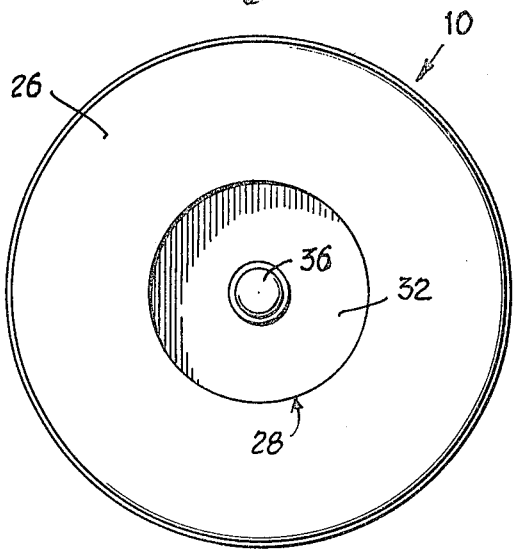
FIG. 2 is a top plan view of the container of FIG. 1.

Referring to the figures and in accordance with the present invention there is provided a novel and improved safety trash container for safely disposing of cigars, cigarettes, small paper wrappers, and the like. The unit features a novel power-operated closure member or dome which shifts to a position wherein it closes off the container automatically, in the event that the contents thereof become inadvertently ignited. Any resulting flames are quickly smothered, and completely confined and isolated from the surrounding environment.

The container is generally designated by the numeral 10 and comprises a receptacle 12 which, in the illustrated embodiment, is shown as having an outer casing or housing part 14 of generally cylindrical configuration, and an inner can or container part 16 which is carried therein. The can or container part 16 is secured to a base plate 18 which is adapted to set on the floor, and three spacer members are provided, designated 20, 22 and 24, for mounting the can to the plate. The spacer members 20–24 are internally threaded at their ends, and carry suitable screws as shown.

The outer casing 14 has a transverse top wall 26 with a central opening 28 to accept the trash being deposited. In the construction illustrated, this wall 26 is shown in the form of a cap having a depending annular flange 30 which is merely pressed onto the remainder of the housing 14. Other means of securement, such as spot welding, could alternately be employed as can be readily understood.

In accordance with the present invention there is provided within the receptacle 12 a closure member 32 in the form of a dome which is movable axially thereof between an open or retracted position, shown in solid outline in FIG. 1, wherein the opening is accessible for deposit of small articles of trash, and a closed or advanced position, shown in dotted outline in FIG. 1, wherein the dome substantially completely sealingly engages the walls of the opening 28 and thereby completely confines the contents of the receptacle in the event of a fire occuring therein. Also provided are powered means for shifting the dome to its closed position, and heat-responsive means for sensing a rise in the internal temperature of the receptacle, due to combustion of the contents thereof, for activating the powered means.

The dome 32 is carried on a threaded piston rod 34 and is secured thereto by a threaded knob 36. A pair of washers 38 (FIG. 5) is disposed on opposite sides of the dome, as shown, and a nut 40 completes the assembly.

The rod 34 extends through a hole 42 in the end of a cylinder 44 which is mounted on a cross bracket 46. The latter extends between the opposite portions of the cylindrical wall of the can 16, being received in slots therein and extending partially into the annular space between the can 16 and housing 14. Holes are provided in the ends of the bracket, to receive cotter pins (not shown) for securing the bracket in position as in FIG. 1.

Associated with the cylinder 44 is a piston 48 which in turn carries the rod 34. The piston has a resilient packing 50 which is sandwiched between a cup-shaped backing member 52 and a washer 54, and secured by nuts 56.

Disposed at the bottom of the cylinder 44 is a plug 58 having threaded side openings or ports 60, 62 which respectively receive fittings 64, 66. A central axial bore 68 is provided, which communicates with the port 60 by means of a tranverse passage 70, and with area above the plug 58 adjacent the location of the piston 48. Connected to the fitting 64 is a mating flare fitting 72 to which one end of a fluid-carrying line 74 extends.

Figure 4:
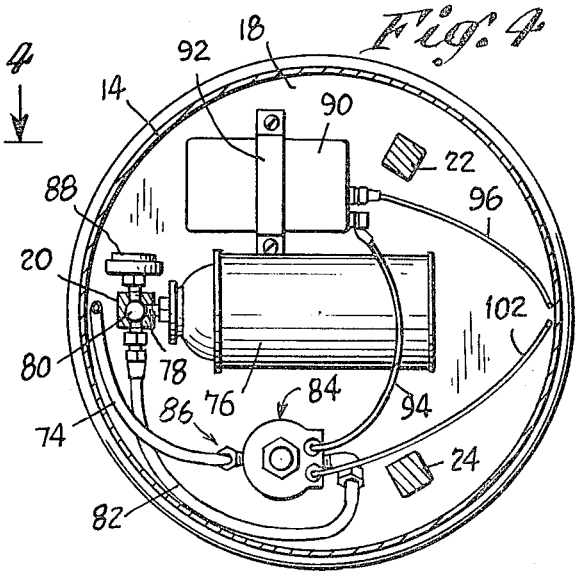
FIG. 4 is a transverse section taken on the line 4—4 of FIG. 1.

Referring now to FIGS. 1 and 4, there is provided between the bottom wall of the can 16 and the base plate 18, a pressurized aerosol can 76 which receives a stem 78 carried in a side opening of the spacer member 20, the latter being hollow as shown, and having an elongate bore 80. The screws carried by the spacer member 20 are indicated by the numeral 81. It will be understood that when the unit is assembled as in FIG. 1, and the screws 81 tightened, the bore will be sealed off from the atmosphere.

The pressurized can preferably contains a suitable extinguishing gas, such as Freon, and has an internal valve (not shown) which is normally closed when the can is not assembled to the spacer member, but which opens as soon as the stem 78 is screwed into the valve of the can. Such aerosol cans are available commercially, and accordingly no further discussion of these is warranted.

Referring again to FIGS. 1 and 4 it can be seen that a pressure line 82 extends from the spacer member 20 to the inlet of an electrical solenoid valve generally designated by the numeral 84. The latter has an outlet port 86 which is connected to the line 74 illustrated in FIG. 1. In addition, a pressure gauge 88 is carried by the spacer member 20, for providing an indication of the condition of charge of the pressurized can 76.

Figure 3:
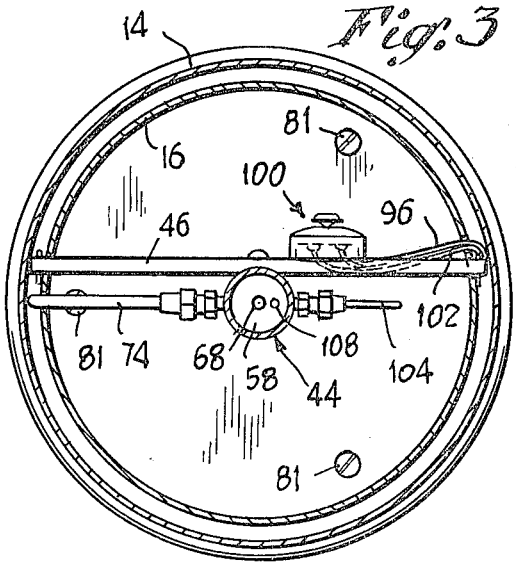
FIG. 3 is a transverse section taken on line 3—3 of FIG. 1, except with the closure member being disposed in the raised or closed position.

Referring again to FIG. 4, there is further provided a battery 90 secured to the base plate 18 by means of a bracket 92, with one lead 94 of the battery extending to the coil of the solenoid valve 84, and the other lead 96 of the battery extending in the space between the housing 14 and can 16, and being connected to a thermostatic switch 100 (FIG. 3) which is mounted on the cross bracket 46 and disposed near the upper portion of the interior of the can 16. Another lead 102 from the coil of the solenoid valve 84 extends to the switch 100, also running between the housing 14 and can 16, and coextensive with the lead 96.

The thermostatic switch 100 can be of a type having a sealed capsule containing ether, and a pair of switch contacts, one of which is movable. Heating of the capsule results in expansion of the ether contained therein, which in turn urges the movable contact into engagement with the other. A thermostatic switch of this type is currently available as commercial product, and is sold at Radio Shack retail stores. Typically the switch contacts close when the capsule temperature reaches 135° F. (RS Stock No. 275506).

Referring again to FIGS. 1 and 5, and in accordance with the invention there is provided a venting arrangement, through a constricted venting port, for bleeding extinguishing gas from the interior of the cylinder 44 (at the area between the packing 50 and the plug 58, when the cylinder is being pressurized) into the interior of the can 16 of the receptacle 12, and in a generally downward direction so as to have a smothering effect on flames resulting from combustible material in the can 16 becoming inadvertently ignited. In accomplishing this, there is provided an additional line 104 and flare fitting 106 extending from the fitting 66, the line 104 having its free end open. This line communicates with the interior of the cylinder 44 by means of a constricted port 108. With the free end of the line 104 being directed downwardly, extinguishing gas is channeled to the lower part of the interior of the can 16, thereby tending to smother any flames resulting from the contents of the can becoming inadvertently ignited.

Figures 5, 6:
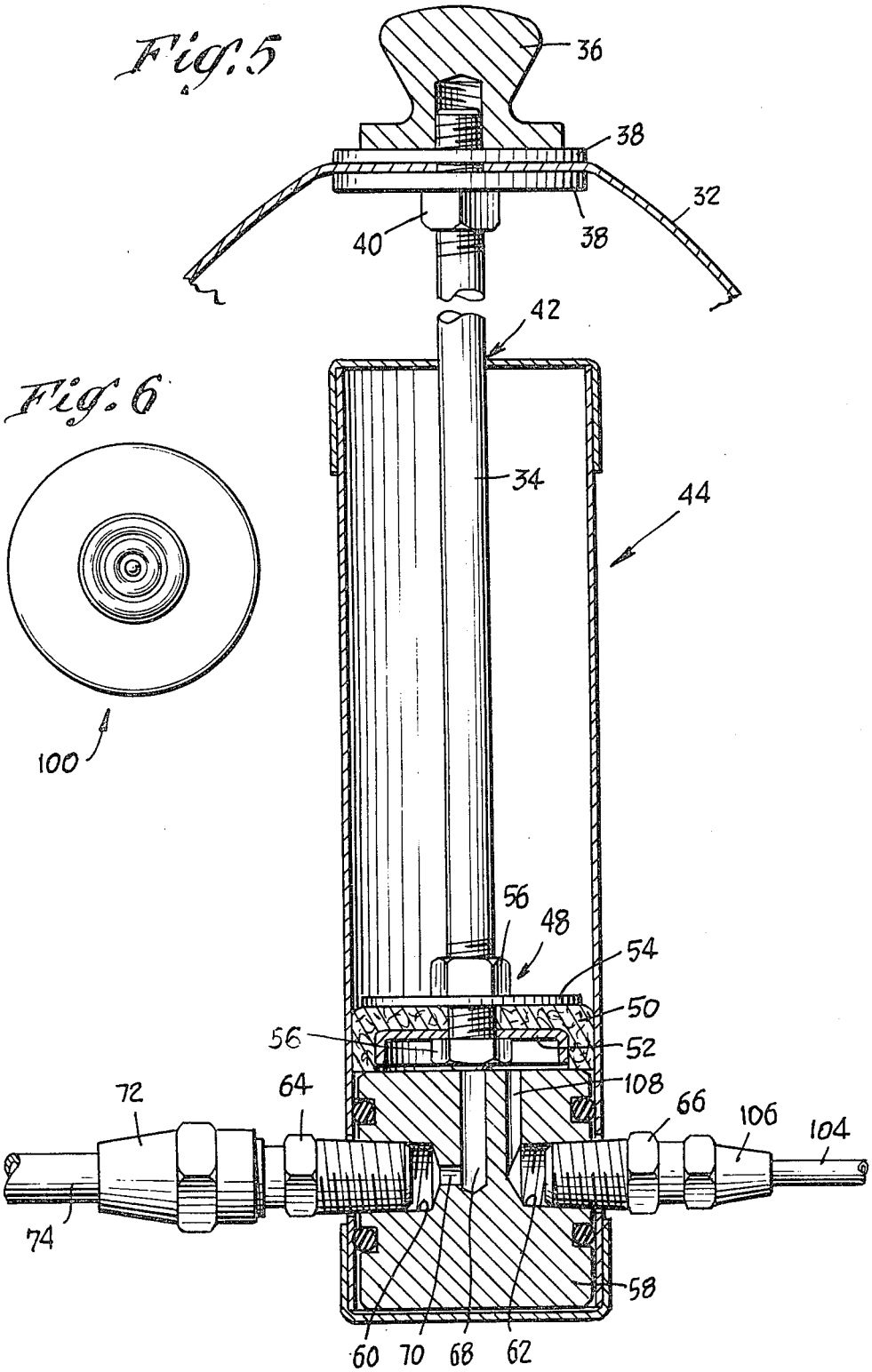
FIG. 5 is a vertical section, greatly enlarged, of an operator device associated with the closure member of the trash container of FIG. 1.
FIG. 6 is a top plan view of a thermostatic switch employed with the safety trash container of FIGS. 1–5.

The operation of the improved safety trash container of the present invention may now be readily understood by referring to FIGS. 1 and 5. Before the container is installed and readied for use, the housing 14 is removed, and a fresh aerosol can 76 of pressurized fluid is installed on the spacer member 20. Such installation effects an opening of the internal valve (not shown) of the can 76, resulting in the establishment of pressure in the hollow 80 of the spacer member 20 and in the line 82.

Since the switch 100 is normally open at room temperature, no energization of the coil of the solenoid valve 84 occurs, and the line 74 is thus isolated from the pressurized line 82.

The outer container or housing 14 is then installed over the inner can 16 such that the cap 26 rests on the annular lip of the can. The dome 32 is disposed in the position illustrated in solid lines in FIG. 1, wherein it is substantially completely retracted within the receptacle 12, providing complete access to the opening 28, for receiving cigarettes, cigars, small paper wrappers, and the like. In the present construction, the fit between the packing 50 and the walls of the cylinder 44, as well as the fit between the piston rod 34 and walls of the opening or hole 42, are sufficiently loose such that the dome 32 settles of its own weight to the open or retracted position of FIG. 1. This assumes, of course, that there is no pressure within the cylinder 44 tending to maintain the dome in a closed position. Such a feature of the invention is considered to be important, since it enables the receptacle to be automatically resetting.

In the event that the inner can 16 becomes filled with small paper articles and a lit cigarette tossed through the opening 28, resulting in an ignition of the paper contents, the resulting smoke and hot gases will quickly effect heating of the thermostatic switch 100. It is noted that this element is disposed near the upper portion of the can 16 (near the bottom of the cylinder 44) such that it is in the best possible position for sensing heat generated by burning material contained therein. As the temperature rises the thermostatic switch 100 closes, bridging electrical leads 96 and 102, and thereby energizing the coil of the solenoid valve 84 through the battery 90, and opening the valve. This in turn effects pressurization of the line 74, this pressure being transmitted through the port 70 and bore 68 to the area adjacent the piston packing 50. Such pressure is sufficient to cause the piston 48 to be driven upwardly in FIG. 5 to the position shown in dotted outline in FIG. 1, and at the same time establish a moderate flow of gas through the constricted port 108 and out through the line 104. The walls of the opening 28 are thus engaged by the dome 32 at a circular area thereof, perpendicular to its axis and disposed midway between its base and its crest. The tapered configuration enables the dome to be self-seating or self-centering, thereby permitting a good seal with the walls of the opening 28, and resulting in a pronounced smothering effect on the fire. There are several advantages inherent in this particular construction. By virtue of the venting provided by the constricted port 108, the increase in pressure within the cylinder 44 is insufficient to cause a sharp or snap upward movement of the dome 32. This has an important advantage in that the force with which the dome 32 engages the walls of the opening 28 is insufficient to cause injury to any personnel who happen to have their hands or fingers in the immediate area. In addition, the venting of the extinguishing gas through the line 104 has several important effects. Prior to the engagement of the dome 32 with the walls of the opening 28, an upward flow of air is established within the container along the side walls thereof, such flow not only cooling the contents of the can 16, thereby tending to slow the rate of combustion, but in addition tending to drive a large percentage of the oxygen-containing air originally occupying the container out the top opening 28, this air being largely replaced by the extinguishing gas. Thus, the desired effect of removing oxygen from the reaction is also realized, thereby slowing the rate of combustion. The replacement of oxygen-containing air as noted above occurs quite rapidly, and prior to the engagement of the dome 32 with the walls of the opening 28. That is to say, by the time the dome 32 has reached the position indicated by the dotted outlines in FIG. 1, most of the air originally contained in the can has been displaced. The presence of the extinguishing gas also provides a very pronounced slowing of the rate of combustion.

When the dome has reached its fully advanced position as in FIG. 1 (dotted outline), it can be seen that a large portion protrudes a considerable distance beyond the surrounding surfaces of the top wall 26. Such protrusion provides a positive indication that a fire has occured within the receptacle. As soon as the fire is mostly extinguished, the thermostatic switch 100 opens, thereby de-pressurizing the cylinder 44 and enabling the dome 32 to return of its own weight, to the open position. The cooling of the thermostatic switch is somewhat enhanced by the presence of the extinguishing gas emanating from line 104. The temperature of this gas can be considerably below that of the surrounding room. As is well known in the art, when a gas under pressure expands, it absorbs a great deal of heat. Thus both the walls of the can 16 and the contents thereof are cooled, this having the beneficial effect of tending to slow the rate of combustion.

In the event that the size of the fire is relatively small, it can be assumed that the thermostatic switch opened before the contents of the pressurized aerosol can 76 were completely depleted. Such depletion of the contents of the can is controlled, and limited to an extent, by the constriction of the port 108.

The above construction is seen to have distinct advantages in that it is especially rugged. Since the line 74 carries substantially the full pressure of the aerosol can 76, it is important that the line be concealed, and protected from rough handling. In the present construction, this object is accomplished by running the line between the annular walls of the can 16 and housing 14. In the event of a leak, or explosion of the pressurized system, the surrounding personnel are adequately protected at all times, by virtue of the closed housing 14.

The arrangement wherein the battery 90, the solenoid valve 84 and the pressurized can 76 are disposed between the bottom wall of the receptacle can 16 and the base plate 18 also affords similar protection in that these components are isolated and protected from inadvertent jarring and/or rough handling.

The same is true of the electrical leads 96, 102. They extend between the annular walls of the housing 14 and can 16, and are thus not susceptible to breakage or inadvertent short-circuiting.

Periodic emptying of the can 16 is readily effected. Since the housing 14 merely rests on the lip of the can, it can be easily lifted off, thereby exposing the large opening of the can defined by its lip. The can is then turned upside down in the conventional manner, and then readied for subsequent use, by replacement of the housing 14. None of the other components carried by the can 16 need be disturbed as this is done.

From the above it can be seen that we have provided a novel safety trash container which is simple in construction and which operates automatically to extinguish fires which become inadvertently started therein. The unit is extremely rugged and safe, and capable of long life expectancy. Relatively few moving parts are involved, thereby minimizing the necessity of periodic maintenance. The only elements of the container requiring replacement are the pressurized aerosol can and the battery. As noted above, such replacement is readily effected by merely removing the housing 14, and substituting new components.

The device is thus seen to represent a distinct advance and improvement in the technology of trash containers.

Each and every one of the appended claims defines a distinct aspect of the invention separate from the others, and each claim is accordingly to be treated in this manner when the prior art devices are examined in any determination of novelty or validity.

Variations and modifications are possible without departing from the spirit of the invention.

We claim:

1. A safety trash-container for the disposal of cigarettes, papers and the cigars, comprising in combination:

(a) a receptacle having an opening at one end, (b) a closure member adapted to fit said opening, (c) means mounting the closure member within the receptacle for movement between a closed position wherein it spans the opening of the receptacle and substantially seals off the opening, and an open position wherein said opening is accessible for the deposit of said cigarettes and papers, (d) heat responsive means disposed within the receptacle for sensing a rise in the internal temperature thereof, as a consequence of igniting of the contents thereof, and (e) powered means rendered operable by said heat responsive means, for shifting the closure member to its closed position, thereby to substantially seal off the receptacle opening and confine and smother flames resulting from a fire occuring therein.

2. The invention as defined in claim 1, wherein:

(a) said powered means comprises a pressurized aerosol can, (b) a hydraulic cylinder and a piston carried thereby, (c) said mounting means comprising a piston rod carrying the closure member, said rod being connected to and movable with said piston in the cylinder, and (d) means connecting said cylinder to the pressurized can to enable the pressurized contents of the can to be transferred to the cylinder, to thereby operate the piston and shift the closure member to its closed position.

3. The invention as defined in claim 2, wherein:

(a) said pressurized can contains an extinguishing gas, and (b) means providing a controlled venting of said extinguishing gas from the cylinder, directed into the interior of the receptacle, for smothering flames occuring therein.

4. The invention as defined in claim 2, wherein:

(a) said piston and cylinder are disposed in an upright position in the receptacle, (b) the sliding fit between the piston and cylinder being sufficiently loose such that during normal operation and in the absence of pressure in the cylinder, the weight of the closure member causes it to assume said open position, wherein the opening is completely accessible for the deposit of trash.

5. The invention as defined in claim 2, and further including:

(a) a bracket carried by the receptacle and extending between opposite wall portions thereof, mounting the cylinder at a location adjacent the top of the receptacle and lying substantially along an axial line thereof.

6. The invention as defined in claim 5, wherein:

(a) said heat responsive means comprises a thermostatic switch (b) said switch being carried on said bracket and disposed inside the receptacle and in spaced relation to the walls thereof.

7. The invention as defined in claim 2, wherein:

(a) said pressurized can contains an extinguishing gas, (b) means providing for venting of said extinguishing gas into the receptacle, (c) said vented gas being directed downwardly into the receptacle, and establishing a upward flow of air along side wall portions thereof and out through the said opening, prior to the closing of the closure member.

8. The invention as defined in claim 2, and further including:

(a) a pressure gauge associated with said aerosol can, to monitor the condition of charge thereof.

9. The invention as defined in claim 2, wherein:

(a) said receptacle comprises a cup-like inner can, and (b) an outer housing disposed over said can, (c) said connecting means comprising a pressurized line extending between the annular walls of said can and housing, said can and housing thereby concealing the line and minimizing the likelihood of damage thereto.

10. The invention as defined in claim 2, wherein:

(a) said receptacle comprises a cup-like inner can, and (b) an outer housing disposed over said inner can, (c) a base plate secured to said inner can and disposed in spaced relation thereto, (d) said aerosol can being disposed between the bottom wall of the inner can and the base plate, (e) said bottom wall and base plate confining the aerosol can and minimizing the likelihood of damage thereto.

11. The invention as defined in claim 10, and further including:

(a) valving means comprising a solenoid valve, disposed in line with said connecting means for selectively isolating the contents of the pressurized can from the cylinder, and (b) a battery for energizing the solenoid valve, (c) said battery and solenoid valve being disposed between the bottom wall of the inner can and the base plate, (d) said bottom wall and base plate confining the solenoid valve and the battery, thereby minimizing the likelihood of damage thereto.

12. The invention as defined in claim 11, wherein:

(a) said heat responsive means comprises a thermostatic switch disposed within the receptacle, (b) means providing an electrical lead from said thermostatic switch to the solenoid valve, (c) said lead running between the walls of the outer housing and the inner can, so as to be confined thereby, minimizing the likelihood of damage to the said lead.

13. The invention as defined in claim 2, and further including:

(a) valving means disposed in line with said connecting means for selectively isolating the contents of the pressurized can from the cylinder, (b) operation of said heat-responsive means effecting opening of the valving means, and establishing communication between the interior of the pressurized can and the cylinder, thereby effecting the shifting of the closure member to its closed position.

14. The invention as defined in claim 13, wherein:

(a) said valving means comprises a solenoid valve, and (b) a battery for energizing the solenoid valve.

15. The invention as defined in claim 14, wherein:

(a) said heat responsive means comprises a thermostatic switch disposed in the receptacle, (b) said switch being connected with said battery and said solenoid valve, for effecting operation of the latter.

16. The invention as defined in claim 1, and further including:

(a) means for introducing an extinguishing fluid into the interior of the receptacle in response to actuation of said heat responsive means, for smothering flames from any combustible material contained therein.

17. The invention as defined in claim 16, wherein:

(a) said extinguishing fluid comprises a gaseous substance, (b) the introduction of said gaseous substance into the receptacle tending to drive the oxygen-containing air from the interior of the receptacle and out through the opening thereof, thereby reducing the rate of combustion of any material contained therein.

18. The invention as defined in claim 16, wherein:

(a) said extinguishing fluid comprises a gas which expands and absorbs heat upon its release into the receptacle, (b) said gas cooling the receptacle and the combustible contents thereof, thereby slowing the rate at which any combustion thereof occurs.

19. The invention as defined in claim 1, wherein:

(a) the opening of said receptacle is substantially circular, (b) said closure member comprising a dome having a major diameter greater than the diameter of said opening, (c) the engagement of the walls of the opening with the lateral surface of the dome occuring at a circular area thereof which is generally perpendicular to the axis of the dome and disposed between the base and crest thereof.

20. The invention as defined in claim 1, wherein:

(a) said receptacle comprises a deep cup-like inner can having an annular lip, and (b) an outer housing having a top wall containing said opening and extending past said lip, (c) said outer housing being removable from the inner can, to facilitate emptying of trash contained therein.

21. The invention as defined in claim 1, wherein:

(a) said closure member is movable between a retracted position wherein it is disposed mostly within the receptacle, and an advanced position wherein at least a portion of the member protrudes through the opening, (b) protrusion of the closure member providing an indication that the heat responsive means has been actuated due to combustion occuring within the receptacle.

22. The invention as defined in claim 1, wherein:

(a) said heat responsive means comprises a thermostatic switch of the sealed capsule type, containing a volatile gas, (b) heating of the capsule effecting expansion of the walls thereof, and resulting in closing of the contacts of the switch.

* * * * *